US011066842B2

(12) United States Patent
Mitchell et al.

(10) Patent No.: US 11,066,842 B2
(45) Date of Patent: Jul. 20, 2021

(54) UNIVERSAL AWNING ANCHOR

(71) Applicants: Michael Allen Mitchell, Letart, WV (US); Teressa Sue Mitchell, Letart, WV (US)

(72) Inventors: Michael Allen Mitchell, Letart, WV (US); Teressa Sue Mitchell, Letart, WV (US)

( * ) Notice: Subject to any disclaimer, the term of this patent is extended or adjusted under 35 U.S.C. 154(b) by 184 days.

(21) Appl. No.: 16/387,478

(22) Filed: Apr. 17, 2019

(65) Prior Publication Data

US 2019/0323256 A1 Oct. 24, 2019

Related U.S. Application Data

(60) Provisional application No. 62/659,236, filed on Apr. 18, 2018.

(51) Int. Cl.

| | |
|---|---|
| ***E04H 12/18*** | (2006.01) |
| ***E04F 10/00*** | (2006.01) |
| ***E04H 12/22*** | (2006.01) |
| ***E04F 10/06*** | (2006.01) |

(52) U.S. Cl.

CPC ..... *E04H 12/182* (2013.01); *E04F 10/00* (2013.01); *E04F 10/0681* (2013.01); *E04H 12/2276* (2013.01); *E04H 12/223* (2013.01); *E04H 12/2223* (2013.01); *E04H 12/2261* (2013.01)

(58) Field of Classification Search

CPC ..... E04H 12/182; E04H 12/2276; E04H 12/2223; E04H 12/223; E04H 12/2261; E04F 10/00; E04F 10/0681

USPC ..... 52/155, 156, 157, 158, 165, 118, 74

See application file for complete search history.

(56) References Cited

U.S. PATENT DOCUMENTS

| | | | | | |
|---|---|---|---|---|---|
| 405,445 | A * | 6/1889 | Thomson | E02D 5/80 | 52/158 |
| 2,508,757 | A * | 5/1950 | Gray | B60J 11/00 | 135/88.08 |
| 3,110,506 | A * | 11/1963 | O'Brien | B60P 7/15 | 410/151 |
| 3,296,757 | A * | 1/1967 | Goodman | H01Q 1/1235 | 52/111 |
| 3,317,168 | A * | 5/1967 | Ziph | E04H 12/2223 | 248/156 |
| 3,612,145 | A * | 10/1971 | Darula | B60P 3/343 | 160/67 |

(Continued)

*Primary Examiner* — Brent W Herring

(57) ABSTRACT

A universal awning anchor is an apparatus that supports an awning with various types of ground, such as soil, concrete, and sand. The apparatus includes a head, a first elongated bar, a second elongated bar, a length-adjustable fastener, and an anchor. The head upholds an awning. The first elongated bar and the second elongated bar define the height of the apparatus. The length-adjustable fastener secures the awning onto the head. The head and the anchor are removable and replaceable with the first elongated bar and the second elongated bar, respectively. The first elongated bar and the second elongated bar are telescopically engaged. The anchor that mounts the apparatus into the soil includes a plurality of threads. The anchor that mounts the apparatus onto concrete includes a plate and a plurality of anchoring holes. The anchor that mounts the apparatus into sand includes a first stake and a second stake.

12 Claims, 5 Drawing Sheets

(56) References Cited

U.S. PATENT DOCUMENTS 3,836,174 A * 9/1974 Holman, Jr. ..... B60P 7/15 410/149
4,171,013 A * 10/1979 Clark ..... B60P 3/343 160/22
4,508,126 A * 4/1985 Everard ..... E04F 10/06 135/114
4,640,332 A * 2/1987 Turner ..... B60P 3/343 160/46
4,727,897 A * 3/1988 Watts ..... E04F 10/0666 135/88.1
4,801,119 A * 1/1989 Pelletier ..... B60P 3/343 135/88.12
5,174,352 A * 12/1992 Murray ..... B60P 3/343 160/67
5,203,393 A * 4/1993 Blevins ..... B60P 3/343 135/88.12
5,207,255 A * 5/1993 Shannon ..... B60P 3/343 160/46
5,307,598 A * 5/1994 West ..... A47G 29/1216 232/39
5,404,682 A * 4/1995 West ..... A47G 29/1216 248/183.1
5,595,204 A * 1/1997 Hwang ..... E04H 15/48 135/142
RE36,550 E * 2/2000 West ..... A47G 29/1216 248/183.1
6,131,638 A * 10/2000 Levin ..... E04F 10/02 160/71
6,382,293 B1 * 5/2002 Brockington ..... E04F 10/0625 160/46
7,281,560 B2 * 10/2007 Hicks ..... E04F 10/0614 160/67
8,627,774 B2 * 1/2014 Pearce ..... E05B 67/383 109/45
9,834,952 B1 * 12/2017 Meyers ..... E04F 10/0648
2010/0258252 A1 * 10/2010 Brutsaert ..... E04F 10/0618 160/48

* cited by examiner

UNIVERSAL AWNING ANCHOR

The current application claims priority to U.S. provisional application Ser. No. 62/659,236 filed on Apr. 18, 2018.

FIELD OF THE INVENTION

The present invention generally relates to awning accessories. More specifically, the present invention is universal awning anchor that accommodates a variety of types of grounds.

BACKGROUND OF THE INVENTION

An awning is a commonly used structure to provide shade in a small area. Many houses employ such a structure in their backyards. The awning is usually connected directly to the side of the house and protrudes outwards perpendicularly. A fabric layered on top of the structure provides shade under the awning. An issue with the current design of an awning is that the supporting framework of the awning is not structurally stable. Simply attaching the structure to a wall only provides two points of support. Other inventions attempt to distribute the weight of the structure onto four points on the wall. However, this still does not provide a firm attachment under extreme weather conditions. During high winds, the awning structure can experience extended periods of stress on the attachment points and possibly cause them to break. Another weak point is the bar of the awning. During extreme weather conditions, the bar tends to break and bend easily, causing the awning to collapse or deform. During large amounts of rainfall or snowfall, the weight of the rain or snow accumulating on the top of the awning also causes stress on the attachment points, leading to a rupture.

An objective of the present invention is to provide additional support to any awning structure during any weather condition or other situation where the awning structure may experience increased stress. The present invention supports an awning pole that also anchors the awning to the ground. The present invention includes three different types of ground anchors for various types of grounds, such as clay, sand, and wood. The present invention is adjustable in that the present invention can adapt to any size and height awning via the adjustable pole mechanism. The head of the present invention is designed to ensure a firm and stable fit around the bar of an awning structure. This prevents the bar of the awning from bending or breaking during extreme weather conditions.

DETAILED DESCRIPTION OF THE INVENTION

Figure 1:
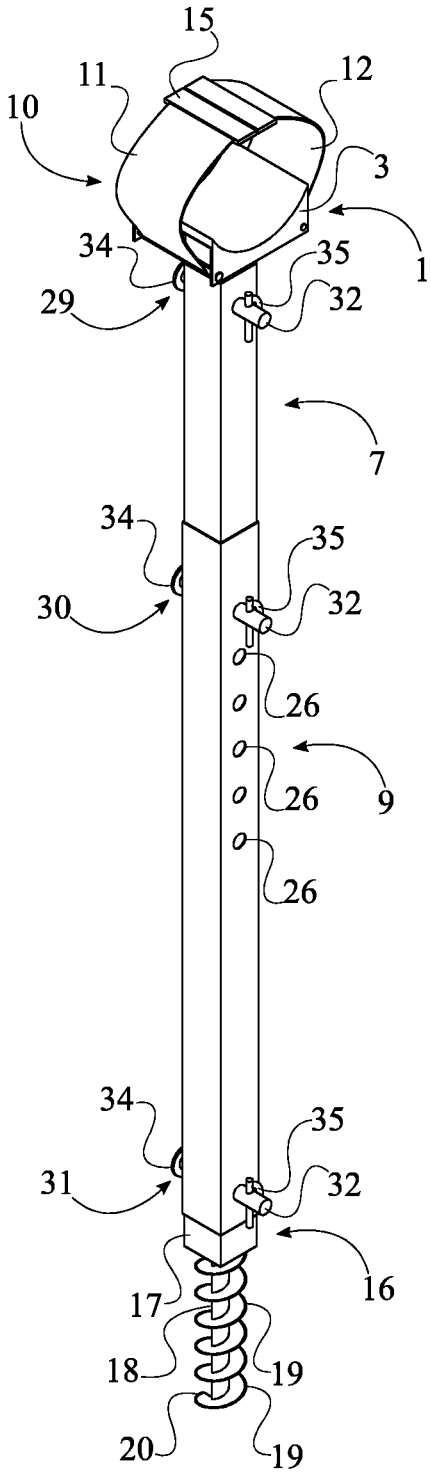
FIG. 1 is a perspective view of a first embodiment of the present invention.

All illustrations of the drawings are for the purpose of describing selected versions of the present invention and are not intended to limit the scope of the present invention.

The present invention is a universal awning anchor that supports and mounts an awning onto a surface. The surface may be a variety of surfaces such as soil, concrete, and sand. The present invention accommodates awnings of varying dimensions, heights, and so on. In order for the present invention to support a variety of awnings, the present invention comprises a head 1, a first elongated bar 7, a second elongated bar 9, a length-adjustable fastener 10, and an anchor 16, seen in FIG. 1, FIG. 2, FIG. 3, FIG. 4, and FIG. 5. The head 1 upholds the awning. The head 1 comprises a first post 2 and a bed 3. The first post 2 connects the bed 3 with the first elongated bar 7. The bed 3 houses a corresponding bar of an awning. The first elongated bar 7 and the second elongated bar 9 connect and offsets the head 1 with the anchor 16. More specifically, the first elongated bar 7 and the second elongated bar 9 defines the height of the awning with respect to a surface. The length-adjustable fastener 10 secures the awning with the head 1. The anchor 16 mounts the second elongated bar 9, and consequently the first elongated bar 7 and the head 1, with the desired surface.

Figure 2:
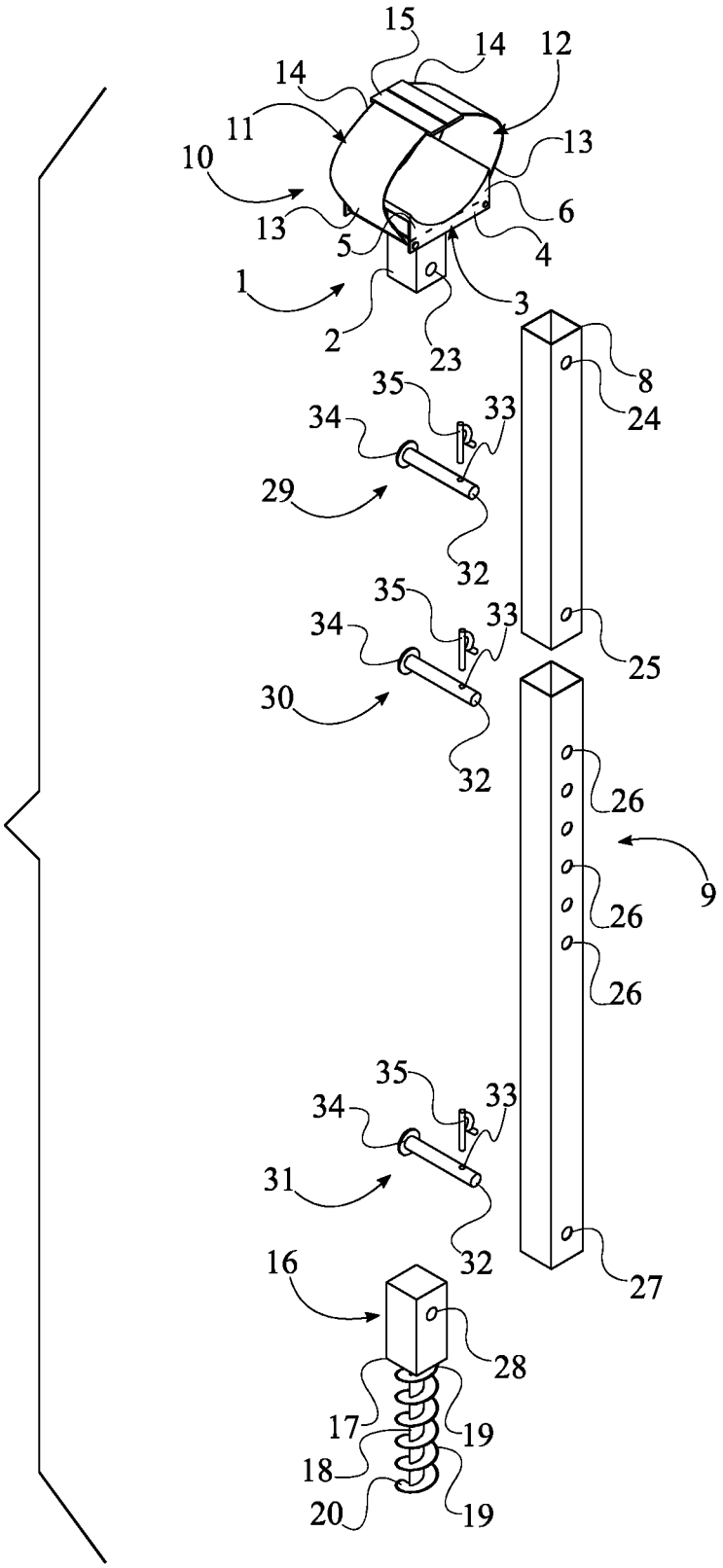
FIG. 2 is an exploded view of the first embodiment of the present invention.

The overall configuration of the aforementioned components allows the present invention to mount a variety of awnings. The awning is connected with the present invention as the bed 3 is terminally fixed with the first post 2 and the length-adjustable fastener 10 laterally traverses across the bed 3, as shown in FIG. 2. More specifically, the length adjustable fastener is mounted with the bed 3 and is positioned opposite the first post 2. In order for the head 1 to remain connected with the first elongated bar 7 while supporting the awning, the first elongated bar 7 is positioned adjacent the first post 2, opposite the bed 3. The head 1 is interchangeable, and the present invention is collapsible, as the first post 2 is removably coupled with a first rim 8 of the first elongated bar 7. The height of the present invention and the distance between the head 1 and a ground are adjustable as the second elongated bar 9 is positioned adjacent the first elongated bar 7, opposite the first post 2, and the first elongated bar 7 is telescopically engaged with the second elongated bar 9. The present invention is mounted with a ground as the anchor 16 is positioned adjacent the second elongated bar 9, opposite the first elongated bar 7 and is integrated with the second elongated bar 9.

In order for an awning to be effectively uplifted with the present invention, the bed 3 comprises a base 4, a first lateral wall 5, and a second lateral wall 6, also seen in FIG. 2. The base 4 upholds a bar of the awning, and both the first lateral wall 5 and the second lateral wall 6 surround the corresponding bar of the awning. The awning is secured with the present invention as the length-adjustable fastener 10 comprises a first strap 11, a second strap 12, and a buckle 15. The first strap 11 and the second strap 12 wrap around the corresponding bar of the awning. The buckle 15 connects and tightens the first strap 11 and the second strap 12 about the corresponding bar of the awning. The head 1 accommodates a variety of awnings as the first lateral wall 5 is terminally fixed across the base 4, and the second lateral wall 6 is fixed across the base 4, positioned opposite the first lateral wall 5. Moreover, the first lateral wall 5 and the second lateral wall 6 are oriented away from the first post 2, and the base 4 is oriented perpendicular with the first lateral wall 5 and the second lateral wall 6. In the preferred embodiment of the present invention, the bed 3 comprises a semicircular cross-section wherein the bed 3 comprises curved surfaces between the first lateral wall 5 and the base 4 as well as the second lateral wall 6 and the base 4. More specifically, the preferred embodiment of the present invention comprises a bed 3 with an inner surface that mirrors the curvature of the corresponding bar of an awning.

A variety of awnings may be secured with the present invention as a fixed end 13 of the first strap 11 is connected across the first lateral wall 5. Similarly, a fixed end 13 of the second strap 12 is connected across the second lateral wall 6, seen in FIG. 2. A free end 14 of the first strap 11 is removably coupled with a free end 14 of the second strap 12 with the buckle 15 so that the awning may be connected and removed with the present invention. It is understood that the buckle 15 may be connected with the first strap 11 and second strap 12 wherein the overall length of the length-adjustable fastener 10 tightly grips around the corresponding bar of the awning.

In order for the head 1 to be removable and interchangeable with the first elongated bar 7, the present invention further comprises a first anchoring slot 23, a second anchoring slot 24, and a first fastener 29, seen in FIG. 2. The first anchoring slot 23 laterally traverses through the first post 2, positioned opposite the bed 3 across the first post 2. Similarly, the second anchoring slot 24 laterally traverses through the first elongated bar 7, positioned adjacent the first post 2. The first post 2 may be engaged with the first elongated bar 7 as the first anchoring slot 23 is vertically aligned with the second anchoring slot 24. Moreover, the first post 2 is operatively coupled with the first elongated bar 7 with the first fastener 29, wherein the first fastener 29 locks and unlocks the first post 2 with the first elongated bar 7 through the first anchoring slot 23 and the second anchoring slot 24.

In the preferred embodiment of the present invention, the first fastener 29 comprises a shaft 32, a pin slot 33, a head 34, and a pin 35, seen in FIG. 1, FIG. 2, FIG. 3, FIG. 4, and FIG. 5. The shaft 32 stops first anchoring slot 23 from slipping past the second anchoring slot 24, and consequently positions the first post 2 within the first elongated bar 7. The pin slot 33 allows the pin 35 to connect with the shaft 32. The head 34 stops the shaft 32 from slipping through both the first anchoring slot 23 and the second anchoring slot 24. The pin 35 secures the position of the shaft 32 within the first anchoring slot 23 and the second anchoring slot 24. In order to secure the shaft 32 within the first anchoring slot 23 and the second anchoring slot 24, the head 34 is terminally fixed with the shaft 32, and the pin slot 33 is traverses through the shaft 32, positioned opposite the head 34. The shaft 32 is slidably engaged through the first anchoring slot 23 and the second anchoring slot 24 so that the first fastener 29 may be inserted and removed from the first anchoring slot 23 and the second anchoring slot 24. The first fastener 29 may be connected and removed with the first post 2 and the first elongated bar 7 as the pin slot 33 is externally positioned with both the first post 2 and the first elongated bar 7. Moreover, the pin 35 is operatively coupled with the shaft 32 through the pin slot 33, wherein the pin 35 and the shaft 32 lock and unlock the first post 2 with the first elongated bar 7.

The height of the present invention is adjustable and defined with the first elongated bar 7 and the second elongated bar 9 as the present invention further comprises a third anchoring slot 25, a plurality of height-adjusting slots 26, and a second fastener 30, seen in FIG. 1, FIG. 2, FIG. 3, FIG. 4, and FIG. 5. The third anchoring slot 25 laterally traverses through the first elongated bar 7, positioned adjacent the second elongated bar 9. Similarly, the plurality of height-adjusting slots 26 laterally traverses through the second elongated bar 9, positioned adjacent the first elongated bar 7. The overall height of the present is adjustable as each of the plurality of height-adjusting slots 26 are distributed along the second elongated bar 9. In order for the third anchoring slot 25 and a corresponding height-adjusting slot of the plurality of height-adjusting slots 26, the third anchoring slot 25 is vertically aligned with each of the plurality of height-adjusting slots 26. The desired height of the apparatus is secured as the first elongated bar 7 is operatively coupled with the second elongated bar 9 with the second fastener 30, wherein the second fastener 30 locks and unlocks the first elongated bar 7 with the second elongated bar 9 through the third anchoring slot 25 and an adjacent height-adjusting slot of the plurality of height-adjusting slots 26.

In the preferred embodiment of the present invention, the second fastener 30 comprises a shaft 32, a pin slot 33, a head 34, and a pin 35, seen in FIG. 2. The shaft 32 stops first anchoring slot 23 from slipping past the corresponding height-adjusting slot 26, and consequently positions the first elongated post within the second elongated bar 9. The pin slot 33 allows the pin 35 to connect with the shaft 32. The head 34 stops the shaft 32 from slipping through both the third anchoring slot 25 and the adjacent height-adjusting slot 26. The pin 35 secures the position of the shaft 32 within the third anchoring slot 25 and the adjacent height-adjusting slot 26. In order to secure the shaft 32 within the third anchoring slot 25 and the adjacent height-adjusting slot 26, the head 34 is terminally fixed with the shaft 32, and the pin slot 33 is traverses through the shaft 32, positioned opposite the head 34. The shaft 32 is slidably engaged through the third anchoring slot 25 and the adjacent height-adjusting slot 26 so that the second fastener 30 may be inserted into and removed from the third anchoring slot 25 and the adjacent height-adjusting slot. The second fastener 30 may be connected and removed with the first elongated bar 7 and the second elongated bar 9 as the pin slot 33 is externally positioned with both the first elongated bar 7 and the second elongated bar 9. Moreover, the pin 35 is operatively coupled with the shaft 32 through the pin slot 33, wherein pin 35 and the shaft 32 lock and unlock the first elongated bar 7 with the second elongated bar 9.

In order for the anchor 16 to be interchangeable with the second elongated bar 9, the present invention further comprises a fourth anchoring slot 27, a fifth anchoring slot 28, and a third fastener 31, seen in FIG. 1 and FIG. 2. In a first embodiment of the present invention, the anchor 16 comprises a second post 17, a shaft 18, a plurality of threads 19, and a pointed end 20. The first embodiment of the present invention comprises an anchor 16 that securely mounts the present invention into soil. The anchor 16 of the first embodiment of the present invention is able to mount the present invention into soil as the shaft 18 is terminally fixed the second post 17, and the plurality of threads 19 is positioned along the shaft 18, opposite the second post 17. Moreover, the plurality of threads 19 is distributed about the shaft 18. This arrangement allows the plurality of threads 19 to latch into the ground. The anchor 16 penetrates the ground as the pointed end 20 is terminally positioned with the shaft 18, adjacent the plurality of threads 19.

As shown in FIG. 2, the anchor 16 may be secured with the second elongated bar 9 as the fourth anchoring slot 27 laterally traverses through the second elongated bar 9, positioned adjacent the second post 17. Similarly, the fifth anchoring slot 28 laterally traverses through the second elongated bar 9, positioned adjacent the second elongated bar 9. The second elongated bar 9 may be engaged with the second post 17 as the fourth anchoring slot 27 is vertically aligned with the fifth anchoring slot 28. Moreover, the second post 17 is operatively coupled with the second elongated bar 9 with the third fastener 31, wherein the third fastener 31 locks and unlocks the second post 17 with the second elongated bar 9 through the fourth anchoring slot 27 and the fifth anchoring slot 28.

In the preferred embodiment of the present invention, the third fastener 31 comprises a shaft 32, a pin slot 33, a head 34, and a pin 35, as seen in FIG. 2. The shaft 32 stops fourth anchoring slot 27 from slipping past the fifth anchoring slot 28, and consequently positions the second post 17 within the second elongated bar 9. The pin slot 33 allows the pin 35 to connect with the shaft 32. The head 34 stops the shaft 32 from slipping through both the fourth anchoring slot 27 and the fifth anchoring slot 28. The pin 35 secures the position of the shaft 32 within the fourth anchoring slot 27 and the fifth anchoring slot 28. In order to secure the shaft 32 within the fourth anchoring slot 27 and the fifth anchoring slot 28, the head 34 is terminally fixed with the shaft 32, the pin slot 33 is traverses through the shaft 32, positioned opposite the head 34. The shaft 32 is slidably engaged through the fourth anchoring slot 27 and the fifth anchoring slot 28 so that the third fastener 31 may be inserted and removed from the fourth anchoring slot 27 and the fifth anchoring slot 28. The third fastener 31 may be connected and removed with the second post 17 and the second elongated bar 9 as the pin slot 33 is externally positioned with both the second post 17 and the second elongated bar 9. Moreover, the pin 35 is operatively coupled with the shaft 32 through the pin slot 33, wherein the pin 35 and the shaft 32 lock and unlock the second post 17 with the second elongated bar 9.

Figure 3:
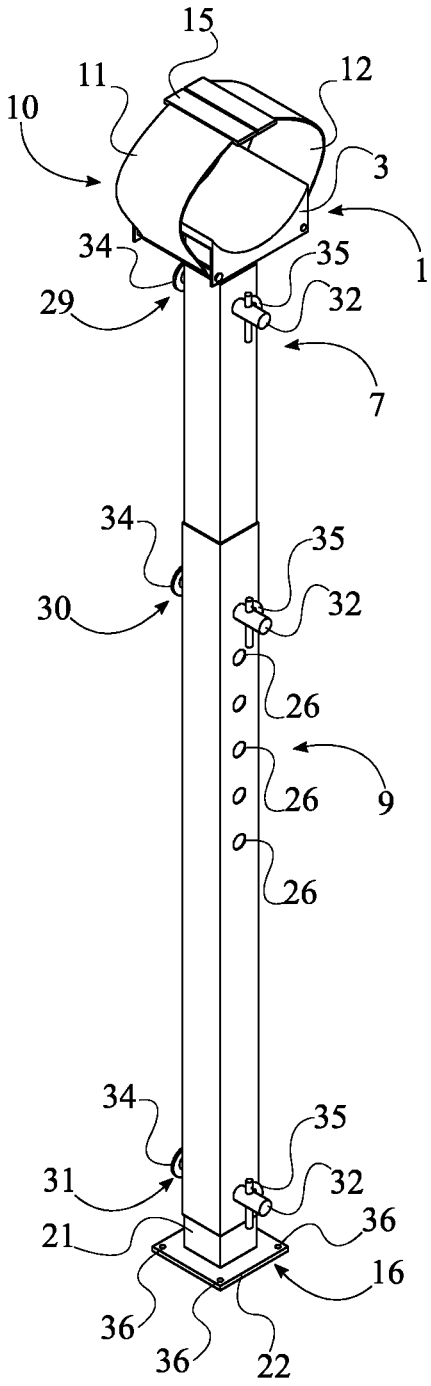
FIG. 3 is a perspective view of a second embodiment of the present invention.

In a second embodiment of the present invention, shown in FIG. 3, the anchor 16 securely mounts the present invention onto a concrete surface or similar rigid surface. Similar to the first embodiment of the present invention, the second embodiment of the present invention further comprises a fourth anchoring slot 27, a fifth anchoring slot 28, a plurality of anchoring holes 36, and a third fastener 31. In the second embodiment of the present invention, the anchor 16 comprises a second post 21 and a plate 22. The second post 21 connects the plate 22 with the second elongated bar 9, and the plate 22 grasps and presses onto the desired concrete surface. The plurality of anchoring holes 36 allows a plurality of fasteners, such as screws or bolts, to secure the plate 22 with the desired concrete surface while preserving the structural integrity of the plate 22. The anchor 16 of the second embodiment of the present invention is able to mount the present invention onto the desired concrete surface as the plate 22 is terminally fixed to the second post 21, positioned opposite the second elongated bar 9. Moreover, the plate 22 is oriented perpendicular with the second post 21. It is understood that in various embodiments of the present invention the plate 22 may comprise a second surface, positioned opposite the shaft 32, with a curvature that mirrors that of the desired concrete surface. The plurality of anchoring holes 36 is perimetrically distributed around the plate 22 and traverses through the plate 22.

The anchor 16 may be secured with the second elongated bar 9 as the fourth anchoring slot 27 laterally traverses through the second elongated bar 9, positioned adjacent the second post 21. Similarly, the fifth anchoring slot 28 laterally traverses through the second elongated bar 9, positioned adjacent the second elongated bar 9. The second elongated bar 9 engages with the second post 21 as the fourth anchoring slot 27 is vertically aligned with the fifth anchoring slot 28, seen in FIG. 3. Moreover, the second post 21 is operatively coupled with the second elongated bar 9 with the third fastener 31, wherein the third fastener 31 locks and unlocks the second post 21 with the second elongated bar 9 through the fourth anchoring slot 27 and the fifth anchoring slot 28.

Similar to the first embodiment of the present invention, the third fastener 31 preferably comprises a shaft 32, a pin slot 33, a head 34, and a pin 35, seen in FIG. 3. The shaft 32 stops fourth anchoring slot 27 from slipping past the fifth anchoring slot 28, and consequently positions the second post 21 within the second elongated bar 9. The pin slot 33 allows the pin 35 to connect with the shaft 32. The head 34 stops the shaft 32 from slipping through both the fourth anchoring slot 27 and the fifth anchoring slot 28. The pin 35 secures the position of the shaft 32 within the fourth anchoring slot 27 and the fifth anchoring slot 28. In order to secure the shaft 32 within the fourth anchoring slot 27 and the fifth anchoring slot 28, the head 34 is terminally fixed with the shaft 32, and the pin slot 33 is traverses through the shaft 32, positioned opposite the head 34. The shaft 32 is slidably engaged through the fourth anchoring slot 27 and the fifth anchoring slot 28 so that the third fastener 31 may be inserted and removed from the fourth anchoring slot 27 and the fifth anchoring slot 28. The third fastener 31 may be connected and removed with the second post 21 and the second elongated bar 9 as the pin slot 33 is externally positioned with both the second post 21 and the second elongated bar 9. Moreover, the pin 35 is operatively coupled with the shaft 32 through the pin slot 33, wherein the pin 35 and the shaft 32 lock and unlock the second post 21 with the second elongated bar 9.

Figure 4:
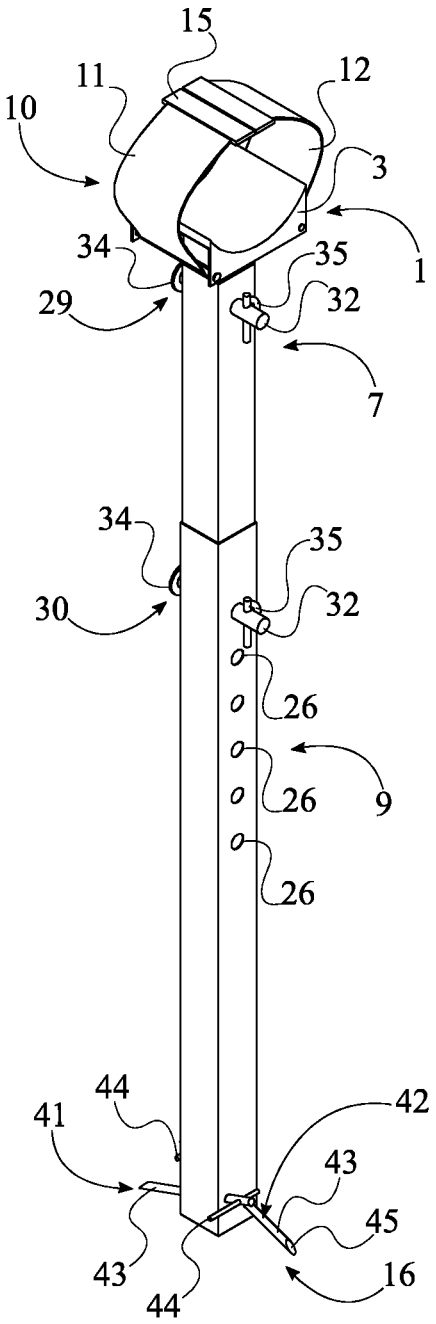
FIG. 4 is a perspective view of a third embodiment of the present invention.
Figure 5:
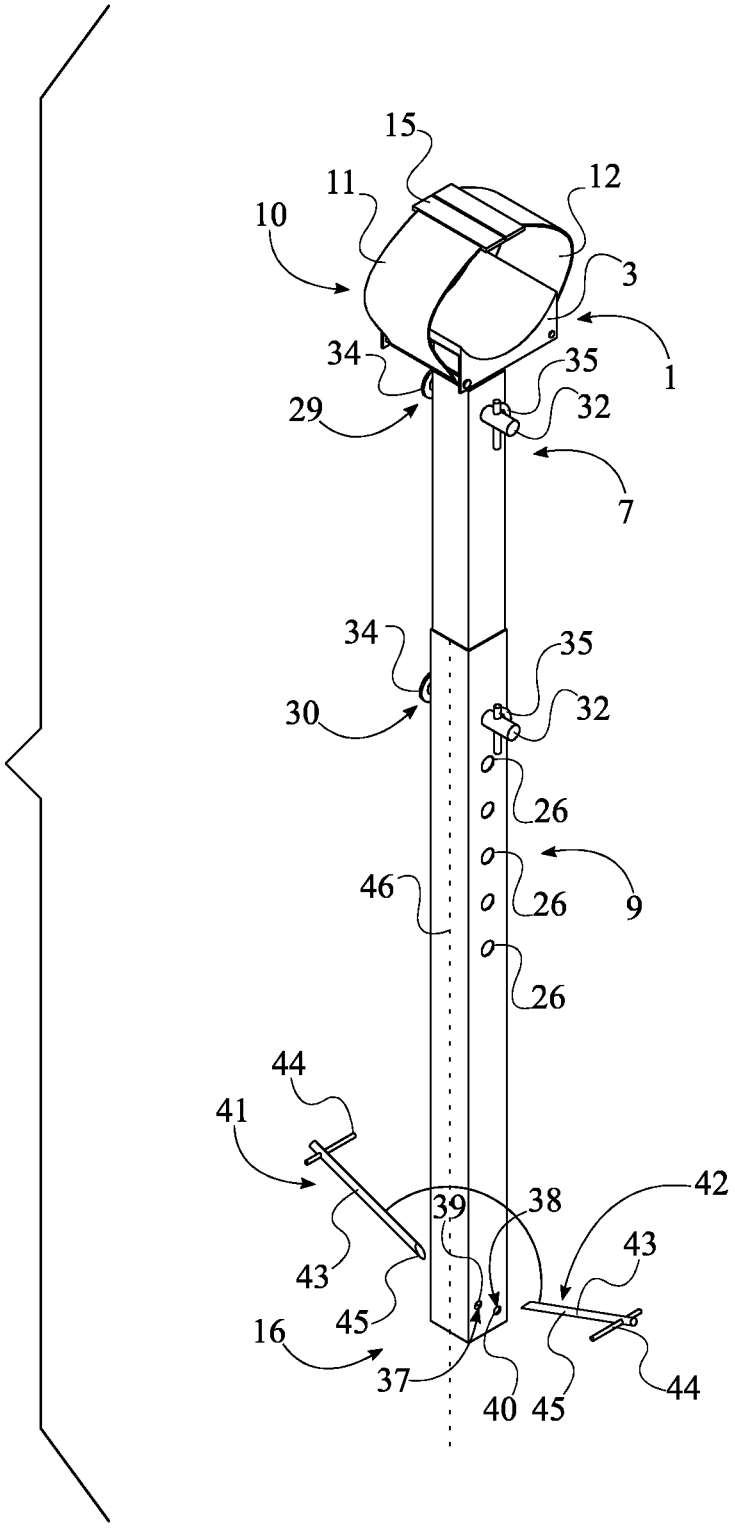
FIG. 5 is an exploded view of the third embodiment of the present invention.

A third embodiment of the present invention is mountable in less dense ground such as sand, seen in FIG. 4 and FIG. 5. In order for the third embodiment of the present invention to be mounted into sand, the third embodiment comprises a first stake-receiving slot 37, a second stake-receiving slot 38, a first stake 41, and a second stake 42. The first stake-receiving slot 37 and the second stake-receiving slot 38 allows the first stake 41 and the second stake 42, respectively, to mount the second elongated bar 9 within sand while preserving the structural integrity of the second elongated bar 9. The second elongated bar 9 is directly mounted within sand as the first stake-receiving slot 37 is positioned adjacent the second stake-receiving slot 38, and the first stake-receiving slot 37 and the second stake-receiving slot 38 laterally traverse through the second elongated bar 9. More specifically, the first stake-receiving slot 37 and the second stake-receiving slot 38 are each oriented at an acute angle with a sagittal plane 46 of the second elongated bar 9. This arrangement orients the first stake 41 and the second stake 42 with the second elongated bar 9 such that the first stake 41 and the second stake 42 with the second elongated bar 9 both balance and secure the present invention into sand. More specifically, an inlet 39 of the first stake-receiving slot 37 is positioned opposite an inlet 39 of the second stake-receiving slot 38 about the second elongated bar 9. In order for the first stake 41 to traverse through the second elongated bar 9, an outlet 40 of the first stake-receiving slot 37 is positioned opposite the inlet 39 of the first stake-receiving slot 37. Similarly, an outlet 40 of the second stake-receiving slot 38 is positioned opposite the inlet 39 of the second stake-receiving slot 38. The outlet 40 of the first stake-receiving slot 37 and the outlet 40 of the second stake-receiving slot 38 are terminally positioned adjacent the second elongate bar so that the first stake 41 and the second stake 42 contact and pierce through the sand. The first stake 41 and the second stake 42 are removable and adjustable with the second elongated bar 9 as the first stake 41 is slidably engaged with the first stake-receiving slot 37, and the second stake 42 is slidably engaged with the second stake-receiving slot 38.

The first stake 41 does not completely traverse through the first stake-receiving slot 37 as the first stake 41 preferably comprises a shaft 43, a stopper plate 44, and a pointed end 45, seen in FIG. 4 and FIG. 5. The shaft 43 allows secures the second elongated bar 9 with the ground. The stopper plate 44 prevents the shaft 43 from slipping past both the inlet 39 and the outlet 40 of the first stake-receiving slot 37. The pointed end 45 facilitates the penetration of the shaft 43 into the sand. The stopper plate 44 is terminally fixed with the shaft 43, and the pointed end 45 is positioned opposite the stopper plate 44 across the shaft 43. The first stake 41 is removable and adjustable with the second elongated bar 9 as the shaft 43 is slidably engaged with the first stake-receiving slot 37. The stopper plate 44 is positioned adjacent the inlet 39 of the first stake-receiving slot 37, and the pointed end 45 is positioned adjacent the outlet 40 of the first stake-receiving slot 37. This arrangement allows the stopper plate 44 to be accessible from above the sand. Moreover, the stopper plate 44 and the pointed end 45 are externally positioned with the second elongated bar 9.

Similar to the first stake 41, the second stake 42 does not completely traverse through the second stake-receiving slot 38 as the second stake 42 preferably comprises a shaft 43, a stopper plate 44, and a pointed end 45, seen in FIG. 4 and FIG. 5. The shaft 43 allows secures the second elongated bar 9 with the ground. The stopper plate 44 prevents the shaft 43 from slipping past both the inlet 39 and the outlet 40 of the first stake-receiving slot 37. The pointed end 45 facilitates the penetration of the shaft 43 into the sand. The stopper plate 44 is terminally fixed with the shaft 43, and the pointed end 45 is positioned opposite the stopper plate 44 across the shaft 43. The second stake 42 is removable and adjustable with the second elongated bar 9 as the shaft 43 is slidably engaged with the second stake-receiving slot 38. The stopper plate 44 is positioned adjacent the inlet 39 of the second stake-receiving slot 38, and the pointed end 45 is positioned adjacent the outlet 40 of the second stake-receiving slot 38. This arrangement allows the stopper plate 44 to be accessible from above the sand. Moreover, the stopper plate 44 and the pointed end 45 are externally positioned with the second elongated bar 9.

Although the invention has been explained in relation to its preferred embodiment, it is to be understood that many other possible modifications and variations can be made without departing from the spirit and scope of the invention as hereinafter claimed.

What is claimed is:

1. A universal awning anchor comprises:
- a head;
- a first elongated bar;
- a second elongated bar;
- a length-adjustable fastener;
- an anchor;
- the head comprises a first post and a bed;
- the bed being terminally fixed with the first post;
- the length-adjustable fastener laterally traversing across the bed;
- the length-adjustable fastener being mounted with the bed;
- the length-adjustable fastener being positioned opposite the first post;
- the first elongated bar being positioned adjacent the first post, opposite the bed;
- the first post being removably coupled with a first rim of the first elongated bar;
- the second elongated bar being positioned adjacent the first elongated bar, opposite the first post;
- the first elongated bar being telescopically engage with the second elongated bar;
- the anchor being positioned adjacent the second elongated bar, opposite the first elongated bar;
- the anchor being integrated with the second elongated bar;
- the bed comprises a base, a first lateral wall and a second lateral wall;
- the length-adjustable fastener comprises a first strap, a second strap, and a buckle;
- the first lateral wall being terminally fixed across the base;
- the second lateral wall being fixed across the base, positioned opposite the first lateral wall;
- the first lateral wall and the second lateral wall being oriented away from the first post;
- the base being oriented perpendicular with the first lateral wall and the second lateral wall;
- a fixed end of the first strap being connected across the first lateral wall;
- a fixed end of the second strap being connected across the second lateral wall; and
- a free end of the first strap being removably coupled with a free end of the second strap with the buckle.

2. The universal awning anchor as claimed in claim 1 comprises:
- a first anchoring slot;
- a second anchoring slot;
- a first fastener;
- the first anchoring slot laterally traversing through the first post, positioned opposite the bed across the first post;
- the second anchoring slot laterally traversing through the first elongated bar, positioned adjacent the first post;
- the first anchoring slot being vertically aligned with the second anchoring slot; and,
- the first post being operatively coupled with the first elongated bar with the first fastener, wherein the first fastener locks and unlocks the first post with the first elongated bar through the first anchoring slot and the second anchoring slot.

3. The universal awning anchor as claimed in claim 2 comprises:
- the first fastener comprises a shaft, a pin slot, a head, and a pin;
- the head being terminally fixed with the shaft;
- the pin slot traversing through the shaft, positioned opposite the head;
- the shaft being slidably engaged through the first anchoring slot and the second anchoring slot;
- the pin slot being externally positioned with both the first post and the first elongated bar; and,
- the pin being operatively coupled with the shaft through the pin slot, wherein the pin and the shaft lock and unlock the first post with the first elongated bar.

4. The universal awning anchor as claimed in claim 2 comprises:
- a third anchoring slot;
- a plurality of height-adjusting slots;
- a second fastener;
- the third anchoring slot laterally traversing through the first elongated bar, positioned adjacent the second elongated bar;
- the plurality of height-adjusting slots laterally traversing through the second elongated bar, positioned adjacent the first elongated bar;
- each of the plurality of height-adjusting slots being distributed along the second elongated bar;
- the third anchoring slot being vertically aligned with each of the plurality of height-adjusting slots; and, the first elongated bar being operatively coupled with the second elongated bar with the second fastener, wherein the second fastener locks and unlocks the first elongated bar with the second elongated bar through the third anchoring slot and an adjacent height-adjusting slot of the plurality of height-adjusting slots.

5. The universal awning anchor as claimed in claim 4 comprises:

the second fastener comprises a shaft, a pin slot, a head, and a pin;

the head being terminally fixed with the shaft;

the pin slot traversing through the shaft, positioned opposite the head;

the shaft being slidably engaged through the first anchoring slot and the second anchoring slot;

the pin slot being externally positioned with both the first elongated bar and the second elongated bar; and, the pin being operatively coupled with the shaft through the pin slot, wherein the pin and the shaft lock and unlock the first elongated bar with the second elongated bar.

6. The universal awning anchor as claimed in claim 4 comprises:

a fourth anchoring slot;

a fifth anchoring slot;

a third fastener;

the anchor comprises a second post, a shaft, a plurality of threads, and a pointed end;

the shaft being terminally fixed to the second post;

the plurality of threads being positioned along the shaft, opposite the second post;

the plurality of threads being distributed about the shaft;

the pointed end being terminally positioned with the shaft, adjacent the plurality of threads;

the fourth anchoring slot laterally traversing through the second elongated bar, positioned adjacent the second post;

the fifth anchoring slot laterally traversing through the second post, positioned adjacent the second elongated bar;

the fourth anchoring slot being vertically aligned with the fifth anchoring slot; and, the second post and the second elongated bar being operatively coupled with the second elongated bar with the third fastener, wherein the third fastener locks and unlocks the second post with the second elongated bar through the fourth anchoring slot and the fifth anchoring slot.

7. The universal awning anchor as claimed in claim 6 comprises:

the third fastener comprises a shaft, a pin slot, a head, and a pin;

the head being terminally fixed with the shaft;

the pin slot traversing through the shaft, positioned opposite the head;

the shaft being slidably engaged through the first anchoring slot and the second anchoring slot;

the pin slot being externally positioned with both the second post and the second elongated bar; and, the pin being operatively coupled with the shaft through the pin slot, wherein the pin and the shaft lock and unlock the second post with the second elongated bar.

8. The universal awning anchor as claimed in claim 4 comprises:

a fourth anchoring slot;

a fifth anchoring slot;

a plurality of anchoring holes;

a third fastener;

the anchor comprises a second post and a plate;

the plate being terminally fixed to the second post;

the plate being oriented perpendicular with the second post;

the plurality of anchoring holes being perimetrically distributed around the plate;

the plurality of anchoring holes traversing through the plate;

the plate being positioned adjacent the second elongated bar;

the fourth anchoring slot laterally traversing through the second elongated bar, positioned adjacent the second post;

the fifth anchoring slot laterally traversing through the second post, positioned adjacent the second elongated bar;

the fourth anchoring slot being vertically aligned with the fifth anchoring slot; and, the second post being operatively coupled with the second elongated bar with the third fastener, wherein the third fastener locks and unlocks the second post with the second elongated bar through the fourth anchoring slot and the fifth anchoring slot.

9. The universal awning anchor as claimed in claim 8 comprises:

the third fastener comprises a shaft, a pin slot, a head, and a pin;

the head being terminally fixed with the shaft;

the pin slot traversing through the shaft, positioned opposite the head;

the shaft being slidably engaged through the first anchoring slot and the second anchoring slot;

the pin slot being externally positioned with both the second post and the second elongated bar; and, the pin being operatively coupled with the shaft through the pin slot, wherein the pin and the shaft lock and unlock the second post with the second elongated bar.

10. The universal awning anchor as claimed in claim 1 comprises:

a first stake-receiving slot;

a second stake-receiving slot;

a first stake;

a second stake;

the first stake-receiving slot being positioned adjacent the second stake-receiving slot;

the first stake-receiving slot and the second stake-receiving slot laterally traversing through the second elongated bar;

the first stake-receiving slot and the second stake-receiving slot each being oriented at an acute angle with a sagittal plane of the second elongated bar;

an inlet of the first stake-receiving slot positioned opposite an inlet of the second stake-receiving slot about the second elongated bar;

an outlet of the first stake-receiving slot being positioned opposite the inlet of the first stake-receiving slot;

an outlet of the second stake-receiving slot being positioned opposite the inlet of the second stake-receiving slot;

the outlet of the first stake-receiving slot and the outlet of the second stake-receiving slot being terminally positioned adjacent the second elongated bar; and, the first stake being slidably engaged with the first stake-receiving slot;

the second stake being slidably engaged with the second stake-receiving slot.

11. The universal awning anchor as claimed in claim 10 comprises:

the first stake comprises a shaft, a stopper plate, and a pointed end;

the stopper plate being terminally fixed with the shaft;

the pointed end being positioned opposite the stopper plate across the shaft;

the shaft being slidably engaged with the first stake-receiving slot;

the stopper plate being positioned adjacent the inlet of the first stake-receiving slot;

the pointed end being positioned adjacent the outlet of the first stake-receiving slot; and, the stopper plate and the pointed end being externally positioned with the second elongated bar.

12. The universal awning anchor as claimed in claim 10 comprises:

the second stake comprises a shaft, a stopper plate, and a pointed end;

the stopper plate being terminally fixed with the shaft;

the pointed end being positioned opposite the stopper plate across the shaft;

the shaft being slidably engaged with the second stake-receiving slot;

the stopper plate being positioned adjacent the inlet of the second stake-receiving slot;

the pointed end being positioned adjacent the outlet of the second stake-receiving slot; and, the stopper plate and the pointed end being externally positioned with the second elongated bar.

* * * * *